US006273607B1

(12) United States Patent
Buchman

(10) Patent No.: US 6,273,607 B1
(45) **Date of Patent: *Aug. 14, 2001**

(54) RECLOSABLE PACKAGE HAVING A SLIDER DEVICE AND TAMPER-EVIDENT STRUCTURE

(75) Inventor: James E. Buchman, Hortonville, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/621,597

(22) Filed: Jul. 21, 2000

Related U.S. Application Data

(60) Provisional application No. 60/176,873, filed on Jan. 18, 2000.

(51) Int. Cl.[7] ..... B65D 33/34

(52) U.S. Cl. ..... 383/5; 383/61; 383/64; 383/203

(58) Field of Search ..... 383/5, 61, 63, 383/64, 203, 204

(56) References Cited

U.S. PATENT DOCUMENTS

| | | | |
|---|---|---|---|
| 3,790,992 | 2/1974 | Herz . | |
| 4,744,674 | 5/1988 | Nocek . | |
| 4,786,190 | 11/1988 | Van Erden et al. . | |
| 4,832,505 | 5/1989 | Ausnit et al. . | |
| 4,874,257 | 10/1989 | Inagaki . | |
| 4,923,309 | 5/1990 | VanErden . | |
| 4,925,316 | 5/1990 | VanErden et al. . | |
| 4,944,603 | 7/1990 | Cornish et al. . | |
| 4,966,470 | 10/1990 | Thompson et al. . | |
| 5,005,707 | 4/1991 | Hustad et al. . | |
| 5,121,997 | 6/1992 | La Pierre et al. . | |
| 5,127,208 | 7/1992 | Custer et al. . | |
| 5,131,121 | 7/1992 | Herrington, Jr. et al. . | |
| 5,224,779 | 7/1993 | Thompson et al. . | |
| 5,456,928 | * 10/1995 | Hustad et al. | 383/61 X |
| 5,488,807 | 2/1996 | Terrenzio et al. . | |
| 5,669,715 | 9/1997 | Dobreski et al. . | |
| 5,713,669 | 2/1998 | Thomas et al. . | |
| 5,911,508 | * 6/1999 | Dobreski et al. | 383/5 |
| 5,924,795 | 7/1999 | Thompson et al. . | |
| 5,964,532 | * 10/1999 | St. Phillips et al. | 383/61 X |
| 6,010,244 | 1/2000 | Dobreski et al. . | |

FOREIGN PATENT DOCUMENTS

| | | | |
|---|---|---|---|
| 0 528 721 A2 | * 2/1993 | (EP) | 383/61 |

* cited by examiner

*Primary Examiner*—Jes F. Pascua

(57) ABSTRACT

A flexible, reclosable package having a reclosable zipper construction openable and closeable by a slider device, and a tamper-evident structure disposed over the zipper construction to provide indication whether access has been gained to the interior of the package. A second tamper-evident structure may be disposed between the zipper construction and the package interior. This second structure may be a web or a peel seal.

21 Claims, 4 Drawing Sheets

RECLOSABLE PACKAGE HAVING A SLIDER DEVICE AND TAMPER-EVIDENT STRUCTURE

Priority under 35 U.S.C. §119(e) is claimed to provisional application serial No. 60/176,873, filed on Jan. 18, 2000, and entitled "Reclosable Package Having a Slider Device and Tamper-Evident Structure". The complete disclosure of application 60/176,873 is incorporated by reference herein.

FIELD OF THE DISCLOSURE

This disclosure concerns reclosable packages. In particular, this disclosure describes packages having slider devices for opening and closing the packages, and also having tamper-evident structures.

BACKGROUND

Flexible packages, in particular resealable and recloseable packages, are frequently used for packaging of consumable goods. Goods that are not used completely when the package is initially opened rely on a zipper closure to reclose the package and keep the remaining contents fresh. Examples of consumable goods that are often packaged in packages, such as bags, with a zipper closure include potting soil, fertilizer, pet food, dog biscuits, vegetables, cereal, and many different foods edible by humans.

Often, the opening and closing of the zipper closure is facilitated by a slider device that is mounted on the zipper closure. The slider device is constructed to pry apart the interlocking zipper closure members when the slider device is moved in a first direction along the zipper, and to engage the interlocking zipper closure members when the slider device is moved in a second, opposite direction along the zipper. For some applications, a tamper-evident structure, to notify whether access has been gained to the zipper closure, is desired. Improvements in these types of packages are desirable.

SUMMARY OF THE DISCLOSURE

The present disclosure relates to a flexible bag, having a resealable, reclosable zipper closure mechanism, opening and closing of which is accomplished by a slider device. The slider device is constructed and arranged for mounting on the closure construction and for interlocking and disengaging the first closure profile with the second closure profile. When the slider device is moved in a first direction, the first closure profile is engaged to the second closure profile; when the slider device is moved in a second opposite direction, the first closure profile is disengaged from the second closure profile. A tamper-evident seal is provided on the exterior of the zipper closure so as to provide evidence whether access has been gained to the interior of the package. Additionally, an internal tamper-evident structure, such as a second tamper-evident structure or a peel seal can be included in the package.

In particular, the disclosure is directed to a flexible, reclosable package comprising first and second panel sections defining an interior and a zipper closure sealed to each of first and second panel sections along a top edge of the package. The zipper extends from a first side edge to a second side edge, and comprises first and second mating profiles. A slider device, constructed and arranged for mounting on the zipper closure and interlocking the first mating profile with the second mating profile when the slider device is moved in a first direction and disengaging the first mating profile from the second mating profile when the slider device is moved in a second opposite direction, is operably mounted on the zipper closure. A tamper-evident structure is disposed at the top edge of the package and encases a first portion of the zipper closure. The tamper-evident structure has a first opening at the first side edge to expose a second portion of the zipper closure, and a second opening at the second side edge to expose a third portion of the zipper closure. The slider device is positioned within the first opening.

Methods of making such a package, and methods of using such a package, are also disclosed.

DETAILED DESCRIPTION

The addition of a slider device to a flexible package, such as a bag, is advantageous to aging or arthritic persons not having the physical ability to use just a zipper closure to reseal a bag. Additionally, the addition of a slider device to a flexible package facilitates the use of the bag by users of all ages and abilities. The presence of an external tamper-evident structure provides assurance that undesired access has not been gained to the interior and contents of the package.

Figure 1:
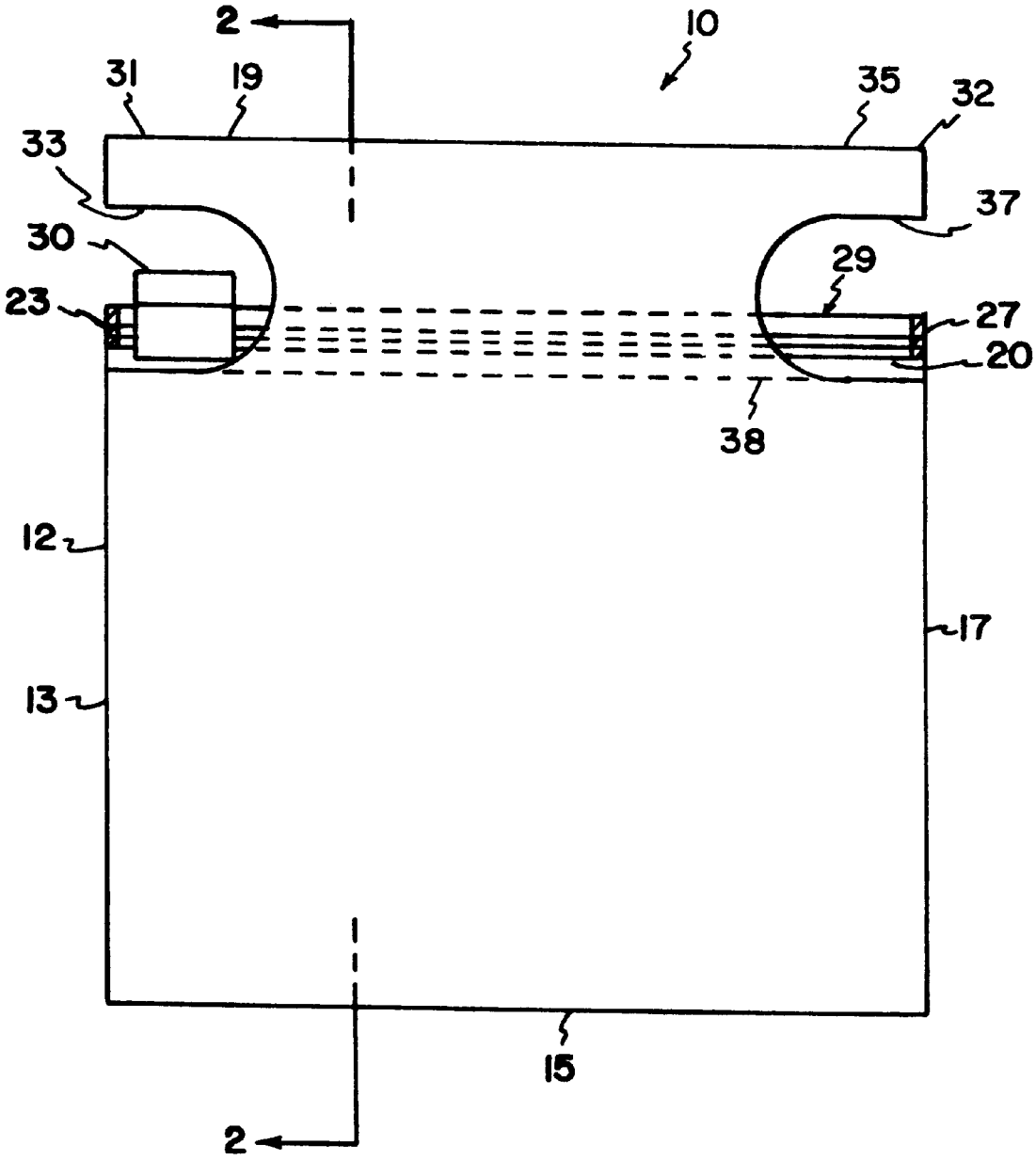
FIG. 1 is a front plan view of a first embodiment of a flexible, reclosable package having a slider device and a tamper-evident structure.
Figure 2:
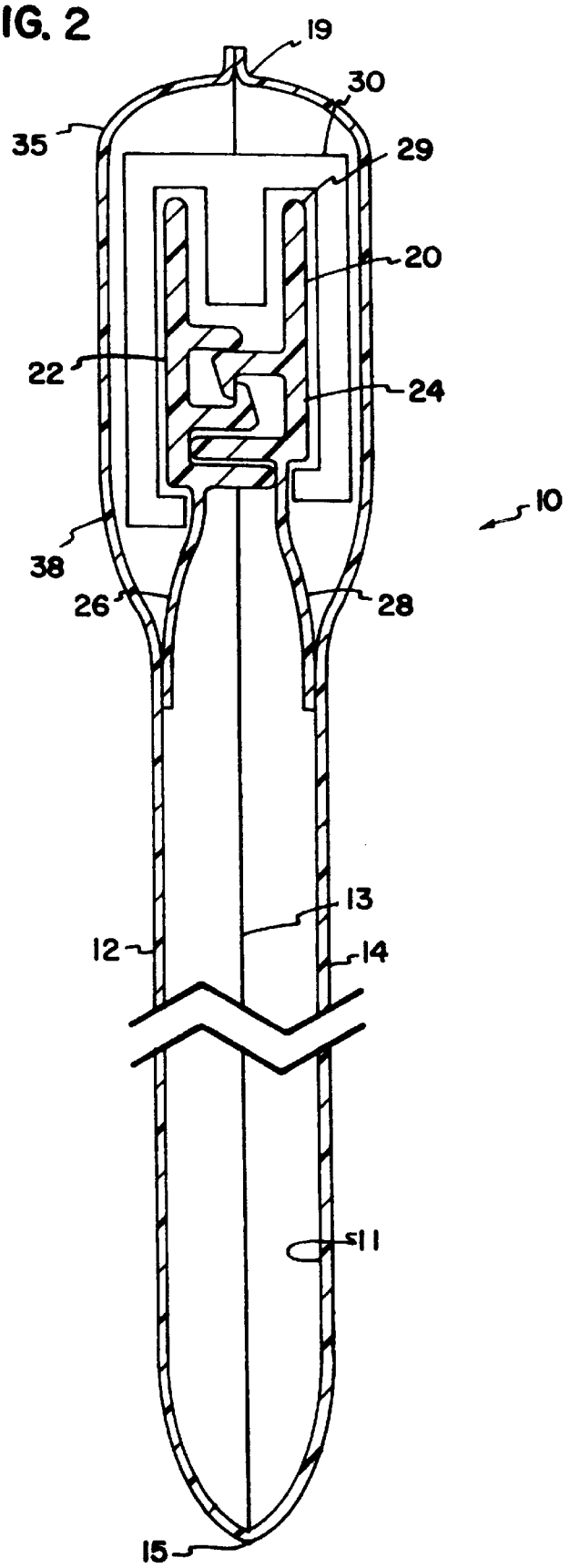
FIG. 2 is a cross-sectional view of the flexible, reclosable package taken along line 2—2 of FIG. 1.

A flexible, reclosable package 10 is shown in FIGS. 1 and 2. Package 10 includes four edges, a first side edge 13, a bottom edge 15, a second side edge 17, and a top edge 19. Providing the structure of package 10 are polymeric film side panels 12 and 14 (FIG. 2), which, with edges 13, 15, 17, define an interior 11, as best seen in FIG. 2.

Side panels 12, 14 are connected to each other at each of side edges 13, 17, bottom edge 15, and top edge 19. In FIG. 1, side edges 13, 17 are seals created by the application of heat and pressure to side panels 12, 14. As best seen in FIG. 2, bottom edge 15 is a fold line between side panels 12, 14, which is formed when a single sheet of film is folded to form the two side panels. In some embodiments, bottom edge 15 can be a seal created by the application of heat and pressure to side panels 12, 14.

A zipper closure arrangement 20 (shown partially in phantom in FIG. 1) having mating closure profiles to open and close (unseal and reseal) the package 10 extends from first side edge 13 to second side edge 17 close to top edge 19 of package 10, as seen in FIG. 1. The zipper closure 20 can include a variety of configurations and structures. Zipper closure 20 can be configured in any known manner, for example, such as disclosed in U.S. Pat. Nos. 4,240,241; 4,246,288; and 4,437,293; each of which is incorporated by reference herein. In FIG. 2, zipper closure 20 is illustrated with mating closure profiles such as a first mating profile 22 and a second mating profile 24. First mating profile 22 and second mating profile 24 engage and disengage, as appropriate, to open and close package 10. Still referring to FIG. 2, first and second mating profiles 22, 24 of zipper closure 20 are attached to the inside of side panels 12, 14, respectively, by sealing flanges 26, 28, respectively.

A slider device 30 is mounted on zipper closure 20 to facilitate opening and closing of zipper closure 20. Slider devices and how they function to open and close zipper closures, in general, are taught, for example, in U.S. Pat. Nos. 5,063,644; 5,301,394; 5,442,837, and 5,664,229, each of which is incorporated by reference herein. A preferred slider device is taught in U.S. patent applications Ser. No. 09/365,215 and 29/108,657, both filed Jul. 30, 1999 and incorporated herein by reference in their entirety. Although shown schematically in FIGS. 1–4, slider device 30 is preferably constructed and arranged in accordance with the disclosures of the patent applications 09/365,215 and 29/108,657.

Two portions of zipper closure 20, one close to first side edge 13 and another close to second side edge 17, act as slider stop areas; these slider stop areas are preferably crushed, such as by ultrasonic crushing, shown as crush areas 23, 27 in FIG. 1. These slider stop areas or crush areas 23, 27 securely seal first and second mating profiles 22, 24 together to minimize the chance of slider device 30 sliding off the side edges 13, 17 of package 10. The slider stop areas or crush areas 23, 27 further minimize the tendency for slider device 30 to abut against either of first side edge 13 or second side edge 17.

A notch (not shown) is preferably disposed within zipper closure 20. The notch is designed to provide a "park place" into which slider device 30 settles when zipper closure 20 is sealed. Such a notch may decrease any tendency for an incomplete interlock between first mating profile 22 and second mating profile 24. Examples of notches are disclosed, for example, in U.S. Pat. Nos. 5,067,208 and 5,301,395, each of which is incorporated by reference herein.

In FIGS. 1 and 2, package 10 includes a tamper-evident structure 35 disposed at top edge 19 to retain slider device 30 close to first side edge 13 and preferably within any notch. By "tamper-evident", it is meant that it provides an indication to the consumer as to whether the package 10 has been previously opened. In order to access the interior 11 (FIG. 2) of package 10, the tamper-evident structure 35 needs to be penetrated. In the embodiment depicted in FIGS. 1 and 2, tamper-evident structure 35 covers and forms a complete enclosure around a majority of the zipper closure 20 while leaving slider device 30 exposed. Generally, tamper evident-structure 35 forms an enclosure around zipper closure 20 for at least 50% of the distance between first side edge 13 and second side edge 17. Preferably, tamper evident-structure 35 forms an enclosure around zipper closure 20 for at least 75%, more preferably at least about 80% of the distance between first side edge 13 and second side edge 17.

As best seen in FIG. 2, tamper-evident structure 35 extends from below zipper closure 20 and encases the entire first and second mating profiles 22, 24. In particular, tamper-evident structure 35 extends from first side edge 13 (FIG. 1) along top edge 19 to second side edge 17. Although tamper evident-structure 35 extends from essentially first side edge 13 to second side edge 17 along the length of zipper closure 20, tamper-evident structure 35 does not encase the entire length of zipper closure 20 nor does tamper evident-structure 35 encase slider device 30. Rather, slider device 30 remains accessible, preferably parked with a notch in zipper closure 20.

A first opening 33 within tamper-evident structure 35 is located at first side edge 13 and a second opening 37 is located at second side edge 17. Each of first opening 33 and second opening 37 exposes a portion of zipper closure 20. Further, slider device 30 is disposed within first opening 33 and is limited to its position within first opening 33 until tamper-evident structure 35 is removed. In one embodiment, the distance between first opening 33 and slider device 30 is no greater than about 2 cm. In another embodiment, this distance is no less than about 0.5 mm. Typically, the distance between first opening 33 and slider device 30 is about 1 mm to 1 cm, and preferably is about 2 mm to 5 mm (0.5 cm).

Openings 33, 37 can be any shape or size desired. For example, openings 33, 37 can be square, rectangular, triangular, or any regular or irregular shape with at least a portion of the shape open; that is, at least one edge is not defined or surrounded by tamper-evident structure 35 of package 10. In the embodiment shown in FIG. 1, openings 33, 37 are each concave regions open at side edges 13, 17.

Within tamper evident-structure 35 above first opening 33 and second opening 37 is a first tab 31 and a second tab 32, respectively. Tabs 31, 32 act as ears or handles to aid during the tearing, ripping, or otherwise removing of tamper-evident structure 35 from package 10. Tab 31 can extend over the width of slider device 30 or can extend only partially over slider device 30; that is, tab 31 may or may not extend to first side edge 13. Tab 32 can be shaped and sized different than tab 31; however, it is preferred that first and second tabs 31, 32 are symmetrical.

Tamper-evident structure 35 is formed by sealing the tops of side panels 12, 14 over zipper closure 20 at top edge 19, as best seen in FIG. 2. Preferably, the seal along top edge 19 of tamper-evident structure 35 is continuous; that is, with no unsealed lengths between side panels 12, 14 along top edge 19. However, in some embodiments spot sealing along top edge 19 may be acceptable. Additionally, in some instances the seal may rip or tear, leaving small lengths of unsealed top edge 19. Each end of tamper-evident structure 35 is also preferably continuously sealed; that is, the perimeter of first opening 33 at first side edge 13 and perimeter of second opening 37 at second side edge 17 are also sealed so that access cannot be gained to zipper closure 20. The sealing of tamper evident-structure 35 and of first and second openings 33, 37 can be done by ultrasonic welding, thermal sealing, crushing, by mechanical attachments, adhesives or solvents, or any combination thereof. It is necessary that the entire edge or perimeter of openings 33, 37 is continuously sealed.

In order to gain access to the package interior 11, slider device 30 must be moved along zipper closure 20, which can only be done if tamper-evident structure 35 has been penetrated; typically tamper-evident structure 35 has to be removed. Tamper-evident evident structure 35 includes an area of weakness 38, which allows for easy removal of tamper-evident structure 35. In some package embodiments, area of weakness 38 is a perforation line, laser score, tear-strip, zip strip, or any type of weakened area that allows for easy removal of tamper-evident structure 35 to expose zipper closure 20 so that slider device 30 can be moved. Area of weakness 38 preferably extends along the length of tamper evident-structure 35, and preferably below the level of zipper closure 20, so that when slider device 30 is moved along zipper closure 20, remnants of tamper evident-structure 35 do not interfere with or hinder the movement of slider device 30.

When tamper-evident structure 35 is present over zipper closure 20, the true top edge 29 of package 10 is encased within tamper-evident structure 35. Typically, the top edge 29 is defined by first and second mating profiles 22, 24. When tamper-evident structure 35 has been removed at perforation line 38, the true top edge 29 is exposed and is the top most portion of package 10, not including slider device 30. There are no further film sections or other structures that extend above top edge 29.

Figure 4:
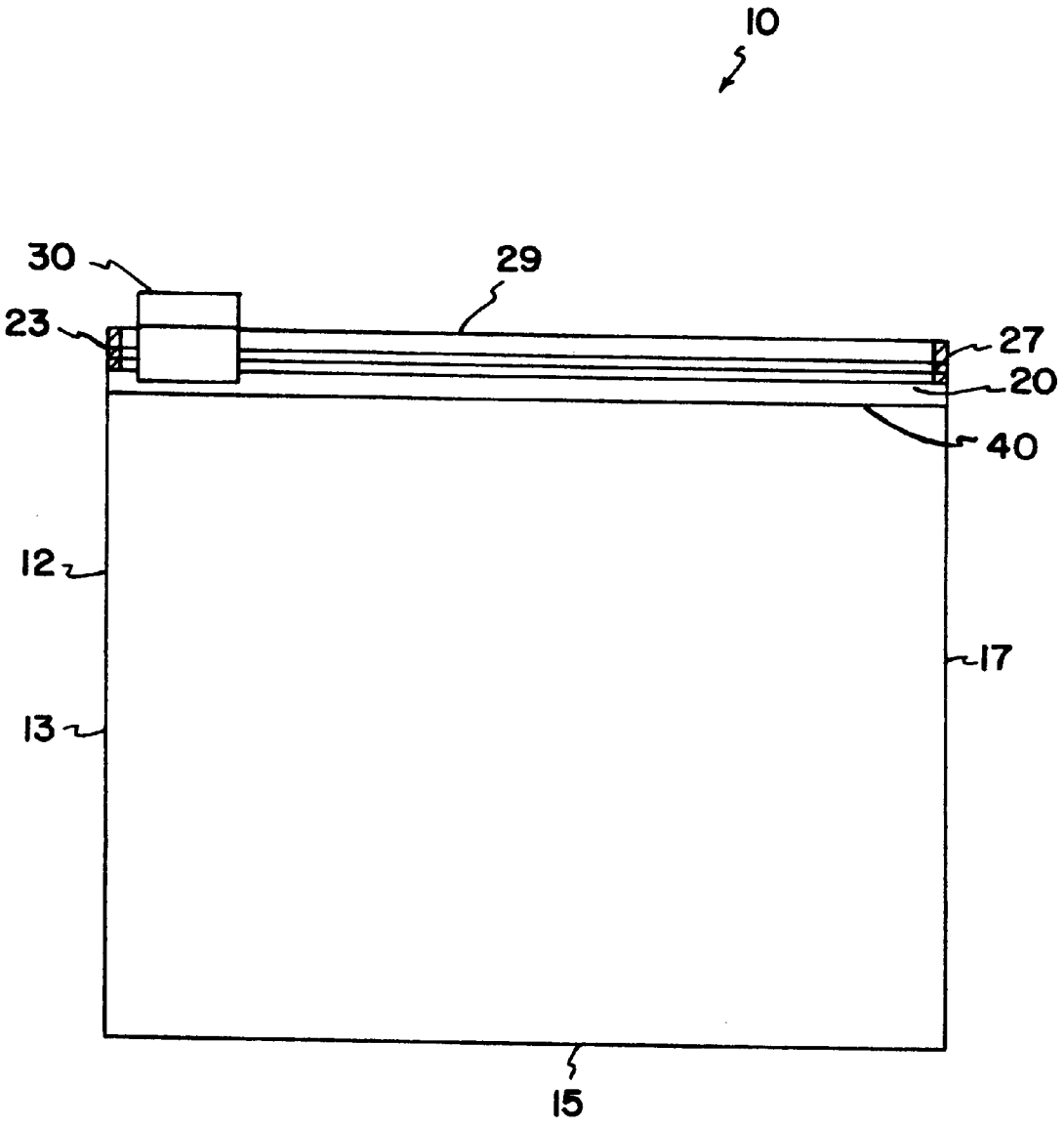
FIG. 4 is a front plan view of the flexible, reclosable package of FIGS. 1 and 2 with the tamper-evident structure removed.

FIG. 4 shows package 10 with tamper-evident structure 35 removed from over zipper closure 20. Top edge 29 is exposed and slider device 30 can be easily moved from first crush area 23 at first side edge 13 along zipper closure 20 to second crush area 27 at second side edge 17 to open zipper closure 20 and gain access to interior 11. Panel edge 40 is exposed where area of weakness 38, such as perforation line, used to be. Note that when the tamper-evident structure 35 is removed, there is no significant amount of tamper-evident structure remaining above where area of weakness 38 used to be. There is no material left that may make physical contact with slider device 30 or that might otherwise impair movement of slider device 30 along zipper closure 20.

Figure 3:
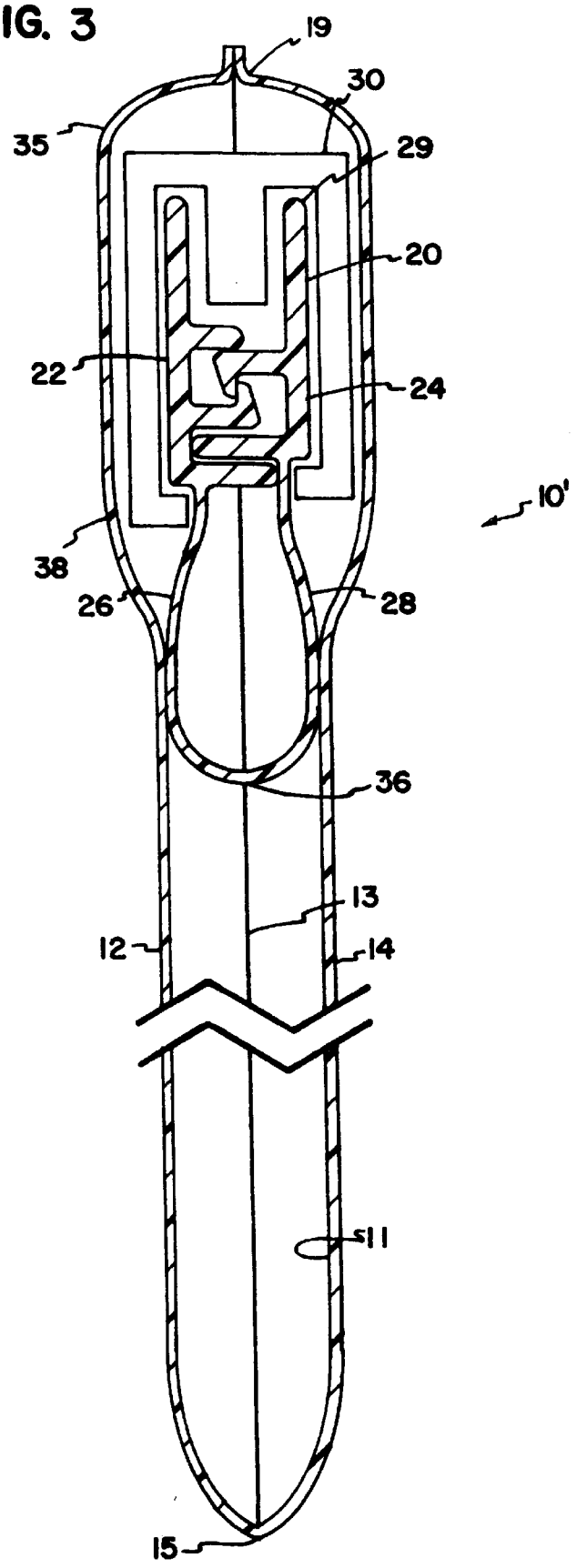
FIG. 3 is a cross-sectional view of a second embodiment of a flexible, reclosable package analogous to the view taken along line 2—2 of FIG. 1.

FIG. 3 illustrates a second embodiment of a package 10', similar to package 10 of FIGS. 1 and 2, except that a second tamper-evident structure is included. As illustrated in FIG. 3, a second tamper-evident structure 36 can be positioned between side panels 12, 14; this provides a second barrier that needs to be broken in order to gain access to interior 11 of package 10'. Generally, this second tamper-evident structure 36 is considered an internal tamper-evident structure, because it is positioned between zipper closure 20 and interior 11. Second tamper-evident structure 36, as shown in FIG. 3, is a web of material, preferably polymeric film, extending between sealing flanges 26, 28 of first and second mating profiles 22, 24 along the length of zipper closure 20. Penetration of this second tamper-evident structure 36 can be accomplished by using a perforation line, a tear bead, zip strip, or the like.

Alternately or additionally, a peel seal can be positioned between side panels 12, 14 or sealing flanges 26, 28 to provide a hermetic barrier for the interior 11. A peel seal can be resealable; that is, it can be opened and resealed multiple times. Alternately, a peel seal can be a single use seal, which, once broken, cannot be resealed. Examples of peel seals are disclosed, for example, in U.S. Pat. Nos. 4,925,316 and 5,893,645, each of which is incorporated by reference herein.

Package 10, and package 10', can be manufactured by techniques generally known in the art of packaging. In one embodiment, side panels 12, 14 may be formed by a single sheet or web of material that has been folded to form bottom edge 15, or two sheets of material can be sealed at bottom edge 15 to form package 10, 10'. Zipper closure 20 is brought between side panels 12, 14 and sealing flanges 26, 28 (FIG. 2) of zipper closure 20 are sealed to side panels 12, 14. In some embodiments, for example to manufacture package 10' of FIG. 3, zipper closure 20 may have second tamper evident structure 36 (FIG. 3) incorporated within.

A topmost portion of each of side panels 12, 14 is brought over to encase zipper closure 20 and slider device 30. By the term "topmost", it is meant the portions of side panels 12, 14 not defining interior 11 (FIG. 2); in another aspect, "topmost" is meant to refer to the portions of side panels 12, 14 that form tamper-evident structure 35. The topmost portions of side panels 12, 14 are sealed at top edge 19 (FIG. 2) and tamper-evident structure 35 is formed. First opening 33 and second opening 37 can be provided in the topmost portions of side panels 12, 14 before or after the side panels are sealed to form tamper-evident structure 35. Openings 33, 37 can be formed by die cutting, slitting, laser cutting, or by any such method.

Side edges 13, 17 are made typically by thermally sealing, and optionally cutting, side panels 12, 14 and zipper closure 20. These side edges 13, 17 can be made before or after tamper-evident structure 35 is made.

To open the bag construction of FIGS. 1 and 2, and of FIG. 3, first tamper-evident structure 35 is removed by tearing along the area of weakness 38, providing access to the zipper closure 20 and slider device 30. This leaves a structure as shown in FIG. 4. The slider device 30 may then be moved from its position at first side edge 13 (FIG. 1) along zipper closure 20 to second side edge 17 (FIG. 1); movement of slider device 30 along zipper closure 20 unmates first and second mating profiles 22, 24 (FIGS. 2 and 3) and provides access to interior 11 (FIG. 2). For packages such as package 10' of FIG. 3, second tamper-evident structure 36 must be breached prior to accessing interior 11.

The above specification is believed to provide a complete description of the manufacture and use of particular embodiments of the invention. Many embodiments of the invention can be made without departing from the spirit and scope of the invention.

We claim:

1. A flexible, reclosable package comprising:

(a) first and second panel sections defining an interior;

(b) a zipper closure sealed to each of first and second panel sections along a top edge and extending from a first side edge to a second side edge, the zipper closure comprising first and second mating profiles;

(c) a slider device constructed and arranged for mounting on the zipper closure and interlocking the first mating profile with the second mating profile when the slider device is moved in a first direction and disengaging the first mating profile from the second mating profile when the slider device is moved in a second opposite direction; the slider device being operably mounted on the zipper closure; and (d) a first tamper-evident structure disposed at the top edge and encasing a first portion of the zipper closure, the first tamper-evident structure having a first opening at the first side edge exposing a second portion of the zipper closure and a second opening at the second side edge exposing a third portion of the zipper closure; the slider device being positioned within the first opening.

2. The package according to claim 1, wherein:

(a) the first tamper-evident structure comprises a first tab and a second tab;

(b) the first tab defined by the first opening; and (c) the second tab defined by the second opening.

3. The package according to claim 2, wherein:

(a) the second portion of the zipper closure is positioned between the first tab and the interior; and (b) the third portion of the zipper closure is positioned between the second tab and the interior.

4. The package according to claim 1, wherein:

(a) the first opening and the second opening are concave.

5. The package according to claim 1, further comprising:

(a) a second tamper evident-structure positioned between the zipper closure and the interior, the second tamper evident-structure extending from the first panel section to the second panel section.

6. The package according to claim 5 wherein:

(a) the first tamper-evident structure comprises a first tab and a second tab;

(b) the first tab defined by the first opening; and (c) the second tab defined by the second opening.

7. The package according to claim 6, wherein:

(a) the second portion of the zipper closure is positioned between the first tab and the interior; and (b) the third portion of the zipper closure is positioned between the second tab and the interior.

8. The package according to claim 7, wherein:

(a) the second tamper evident-structure is an extension of web material between the first and second mating profiles.

9. The package according to claim 1, wherein:

(a) the first portion of the zipper closure extends between the first side edge and the second side edge and comprises at least 50% of the zipper closure.

10. The package according to claim 9, wherein:

(a) the first portion of the zipper closure comprises at least 80% of the zipper closure.

11. The package according to claim 1, wherein:

(a) the first portion of the zipper closure is positioned no more than 1 cm from the slider device.

12. The package according to claim 1, further comprising:

(a) an area of weakness extending along the first tamper-evident structure.

13. The package according to claim 12, wherein:

(a) the area of weakness is a perforation line.

14. The package according to claim 12, wherein:

(a) the area of weakness extends along the first tamper evident-structure below the zipper closure.

15. The package according to claim 1, wherein:

(a) the first side edge includes a first slider stop area and the second side edge includes a second slider stop area.

16. The package according to claim 15, wherein:

(a) the first slider stop areas is a first crush area and the second slider stop area is a second crush area.

17. A method of using a flexible package, the flexible package comprising a package body defining an interior; a zipper closure comprising first and second mating profiles extending along a first edge of the package body, the zipper closure providing access to the interior; a slider device operably mounted on the zipper closure, the slider device interlocking the first closure profile with the second closure profile when the slider device is moved in a first direction and disengaging the first closure profile from the second closure profile when the slider device is moved in a second opposite direction, and a tamper-evident structure encasing a first portion of the zipper closure and comprising: (i) a first opening for providing access to the slider device and a second portion of the zipper closure, and (ii) a second opening for providing access to a third portion of the zipper closure; the method comprising:

(a) removing the tamper-evident structure device from the flexible package; and (b) moving the slider device in a first direction from the second portion to the third portion to disengage the first and second mating profiles, thereby providing access to the package interior.

18. The method according to claim 17, wherein the step of removing the tamper-evident structure from the flexible package comprises:

(a) removing the tamper-evident structure at an area of weakness.

19. The method according to claim 18, wherein the step of removing the tamper-evident structure at an area of weakness comprises:

(a) removing the tamper-evident structure at a perforation line.

20. The method according to claim 17, wherein the step of removing the tamper-evident structure from the flexible package comprises:

(a) removing the tamper evident-structure from the flexible package below the zipper closure.

21. A method of making a package comprising a package body defining an interior; a zipper closure comprising a first mating profile and a second mating profile extending along a first edge of the package body, the zipper closure providing access to the interior; a slider device operably mounted on the zipper closure, the slider device interlocking the first mating profile with the second mating profile when the slider device is moved in a first direction and for disengaging the first mating profile from the second mating profile when the slider device is moved in a second opposite direction, and a tamper-evident structure at least partially encasing the zipper closure; the method comprising:

(a) providing the package body having an interior surface and defining the package interior;

(b) attaching the zipper closure to the interior surface of the package body;

(c) mounting the slider device onto the zipper closure;

(d) forming the tamper-evident structure over the zipper closure and the slider device with the package body by:

(i) sealing the package body above the zipper closure;

(ii) forming a first opening in the tamper-evident structure, at a first end of the tamper-evident structure, in which the slider device resides;

(iii) forming a second opening in the tamper-evident structure at an opposite second end of the tamper-evident structure; and (iv) providing an area of weakness within the tamper-evident structure.

* * * * *